US007348933B2

(12) United States Patent
Nilsson

(10) Patent No.: US 7,348,933 B2
(45) Date of Patent: Mar. 25, 2008

(54) COMPACT MULTI-POLARIZED ANTENNA FOR PORTABLE DEVICES

(75) Inventor: Jack Nilsson, Medina, OH (US)

(73) Assignee: WiFi Plus, Inc., Brunswick Hills, OH (US)

( * ) Notice: Subject to any disclaimer, the term of this patent is extended or adjusted under 35 U.S.C. 154(b) by 0 days.

(21) Appl. No.: 10/786,731

(22) Filed: Feb. 25, 2004

(65) Prior Publication Data

US 2004/0164917 A1 Aug. 26, 2004

Related U.S. Application Data

(63) Continuation-in-part of application No. 10/294,420, filed on Nov. 14, 2002, now Pat. No. 6,806,841, which is a continuation-in-part of application No. 09/803,245, filed on Mar. 9, 2001, now Pat. No. 6,496,152.

(60) Provisional application No. 60/188,464, filed on Mar. 10, 2000.

(51) Int. Cl.
*H01Q 1/36* (2006.01)
*H01Q 1/42* (2006.01)
*H01Q 9/04* (2006.01)
*H01Q 9/44* (2006.01)

(52) U.S. Cl. ..... 343/895; 343/789; 343/791; 343/805; 343/908

(58) Field of Classification Search ..... 343/895, 343/789, 791, 805, 908, 906, 773, 765, 882, 343/900, 797, 807, 835, 833, 824, 792, 901, 343/846

See application file for complete search history.

(56) References Cited

U.S. PATENT DOCUMENTS 1,554,231 A * 9/1925 Press ..... 343/731
2,218,707 A 10/1940 Franz
2,835,893 A * 5/1958 Braund ..... 343/895
3,383,694 A 5/1968 Strohmeyer, Jr.
4,253,099 A 2/1981 Yamazaki et al.
4,958,167 A 9/1990 Schroeder
5,264,858 A * 11/1993 Shiina ..... 343/713
5,406,295 A 4/1995 Baranski et al.
5,561,439 A * 10/1996 Moilanen ..... 343/846
5,805,113 A 9/1998 Ogino et al.
6,300,912 B1 * 10/2001 Pla ..... 343/713
6,486,849 B2 * 11/2002 Buckles ..... 343/808
6,714,170 B2 * 3/2004 Kleinschmidt ..... 343/883

* cited by examiner

OTHER PUBLICATIONS

Broadband Wireless Internet Forum White Paper, "VOFDM Broadband Wireless Transmission and Its Advantages over Single Carrier Modulation; Document No. WP-1_TG-1," Boradband WIreless Internet Forum, 1.2 ed., Broadband WIreless Internet Forum, p. 1-35, (Dec. 15, 2000).

*Primary Examiner*—Don Wong
*Assistant Examiner*—Marie Antoinette Cabucos
(74) *Attorney, Agent, or Firm*—Robert J. Rose; Sheldon Mak Rose & Anderson PC

(57) ABSTRACT

A compact multi-polarized antenna for transmitting and/or receiving radio frequency (RF) signals, and a method for constructing same, is disclosed. The antenna comprises at least two radiative antenna elements each having a first end and a second end. The second ends of the antenna elements are electrically connected at an apex point and are disposed outwardly away from the apex point at an acute angle relative to and to a first side of an imaginary plane intersecting the apex point. The antenna also includes an electrically conductive, non-planar ground reference located at and/or to a second side of the imaginary plane.

26 Claims, 8 Drawing Sheets

2.4 GHz design

Geometric Spatial Capture of Signal polarizations are generated between "+" and "-" between antenna elements and ground reference Phase Delay Directives …

"DFDM" – Doppler Frequency Division Multiplexing

COMPACT MULTI-POLARIZED ANTENNA FOR PORTABLE DEVICES

CROSS-REFERENCE TO RELATED APPLICATIONS/INCORPORATION BY REFERENCE

This application is a continuation-in-part (C-I-P) of patent application Ser. No. 10/294,420 filed on Nov. 14, 2002, now U.S. Pat. No. 6,806,841, which is a continuation-in-part (C-I-P) of patent application Ser. No. 09/803,245 filed on Mar. 9, 2001, now U.S. Pat. No. 6,496,152, which claims the benefit of U.S. provisional application Ser. No. 60/188,464, filed on Mar. 10, 2000, which are incorporated herein by reference in its entirety.

U.S. application Ser. No. 10/787,031 entitled "Apparatus and Method for a Multi-Polarized Antenna" and filed on the same day as the application herein, is incorporated herein by reference in its entirety.

U.S. Pat. No. 6,496,152 issued on Dec. 17, 2002 is incorporated herein by reference in its entirety.

TECHNICAL FIELD

Certain embodiments of the present invention relate to portable antennas for wireless communications. More particularly, certain embodiments of the present invention relate to an apparatus and method providing a compact multi-polarized antenna exhibiting substantial spatial diversity for use in cellular telephone applications, wireless laptop and desktop personal computer (PC) applications, personal/covert applications, maritime applications, aviation applications, satellite and space applications, and planetary radio communications.

BACKGROUND OF THE INVENTION

For years, wireless communications including Wi-Fi, WWAN, and WLAN, Cell/PCS phones, Land Mobile radio, aircraft, satellite, etc. have struggled with limitations of audio/video/data transport and internet connectivity in both obstructed (indoor/outdoor) and line-of-site (LOS) deployments.

A focus on gain as well as circuitry solutions have proven to have significant limitations. Unresolved, non-optimized (leading edge) technologies have often given way to "bleeding edge" attempted resolutions. Unfortunately, all have fallen short of desirable goals, and some ventures/companies have even gone out of business as a result.

While lower frequency radio waves benefit from an 'earth hugging' propagation advantage, higher frequencies do inherently benefit from (multi-) reflection/penetrating characteristics. However, with topographical changes (hills & valleys) and object obstructions (e.g., natural such as trees, and man-made such as buildings/walls) and with the resultant reflections, diffractions, refractions and scattering, maximum signal received may well be off-axis (non-direct path) and multi-path (partial) cancellation of signals results in null/weaker spots. Also, some antennas may benefit from having gain at one elevation angle ('capturing' signals of some pathways), while other antennas have greater gain at another elevation angle, each type being insufficient where the other does well. In addition, the radio wave can experience altered polarizations as they propagate, reflect, refract, diffract, and scatter. A very preferred (polarization) path may exist, however, insufficient capture of the signal can result if this preferred path is not utilized.

Spatial diversity can distinctly help with some of the null-spot issues. Some radio equipment comes equipped with two switched antenna connections to reduce null spot problems experienced by a single antenna due to multi-path signals. A single antenna may receive signals out of phase from different paths, causing the resultant received signal to be nulled out (i.e., the individual signals received from the different paths cancel each other out). With two antennas, if one antenna is experiencing null cancellation, the other, if positioned properly with respect to the first antenna, will not. VOFDM (Vector Orthogonal Frequency Division Multiplexing) technology helps with some multi-path out-of-phase 'data clash' issues. Electronically steer-able antenna arrays alleviate some interference problems and provide a solution where multiple standard directional antenna/radio systems would otherwise be more difficult or clearly impractical. Dual slant polarization antenna/circuitry switching systems have shown much advantage over others in (some) obstructed environments but require additional complex circuitry. Circularly polarized systems can also provide some penetration advantages.

Certainly, gain (increased ability to transmit and receive signals in a particular direction) is important. However, if polarization of the signal and antenna are not matched, poor performance may likely result. For example, if the transmitting antenna is vertically polarized and the receiving antenna is also vertically polarized, then the transmitting and receiving antennas are matched for wireless communications. This is also true for horizontally polarized transmitting and receiving antennas.

However, if a first antenna is horizontally polarized (e.g., a TV house antenna) and a second antenna (e.g., TV transmitting antenna) is vertically polarized, then the signal received by the first antenna will be reduced, due to polarization mismatch, by about 20 dB (e.g., to about $1/100^{th}$ of the signal that could be received if polarizations were matched) or more (theoretically zero signal orthogonally). For example, a vertically polarized antenna with 21 dBi of gain, attempting to receive a nearly horizontally polarized signal, may be essentially a 1 dBi gain antenna with respect to the horizontally polarized signal and may not be effective.

As another example, a vertically or horizontally polarized antenna that is tilted at 45 degrees can receive both vertically and horizontally polarized signals, but at a power loss of 3 dB (½ power). However, if the signal to be received is also at a 45-degree tilt, but perpendicular to the 45-degree tilt of the receiving antenna, then the signal is again reduced to $1/100^{th}$ of the potential received signal. Having two antennas where one is vertically polarized and the other is horizontally polarized can help, but still has its disadvantages.

Therefore, gain is important but, to be effective, polarization should be considered as well. Also, for portable device applications, having an antenna that is both small in overall size and effective in capturing the signal is very important.

Further limitations and disadvantages of conventional, traditional, and proposed approaches will become apparent to one of skill in the art, through comparison of such systems with the present invention as set forth in the remainder of the present application with reference to the drawings.

BRIEF SUMMARY OF THE INVENTION

An embodiment of the present invention provides an apparatus comprising a small, compact multi-polarized antenna for transmitting and/or receiving radio frequency (RF) signals. The antenna comprises at least two radiative antenna elements each having a first end and a second end.

The second ends of the radiative antenna elements are electrically connected at an apex point and are each disposed outwardly away from the apex point at an acute angle relative to and on a first side of an imaginary plane intersecting the apex point. The antenna also includes an electrically conductive, non-planar ground reference located at and/or to a second side of the imaginary plane. The non-planar ground reference increases the omni-directional coverage (total pattern approaching spherical) of the antenna over that of a planar ground reference (i.e., a ground plane) and allows the overall dimensional envelope of the antenna to be more compact, making the antenna more suitable for use in small, mobile devices.

An embodiment of the present invention includes a method to construct a small, compact multi-polarized antenna for transmitting and/or receiving radio frequency (RF) signals. The method comprises generating at least two radiative antenna elements each having a first end and a second end and each being tuned to a predetermined radio frequency. The method further comprises electrically connecting the second ends of the radiative antenna elements at an apex point such that each radiative antenna element is disposed outwardly away from the apex point at an acute angle relative to and on a first side of an imaginary plane intersecting the apex point. The method further includes positioning an electrically conductive, non-planar ground reference at or to a second side of the imaginary plane. The non-planar ground reference increases the omni-directional coverage (total pattern approaching spherical) of the antenna over that of a planar ground reference (i.e., a ground plane) and allows the overall dimensional envelope of the antenna to be more compact, making the antenna more suitable for use in small, mobile devices.

These and other advantages and novel features of the present invention, as well as details of an illustrated embodiment thereof, will be more fully understood from the following description and drawings.

DETAILED DESCRIPTION OF THE INVENTION

Figure 1:
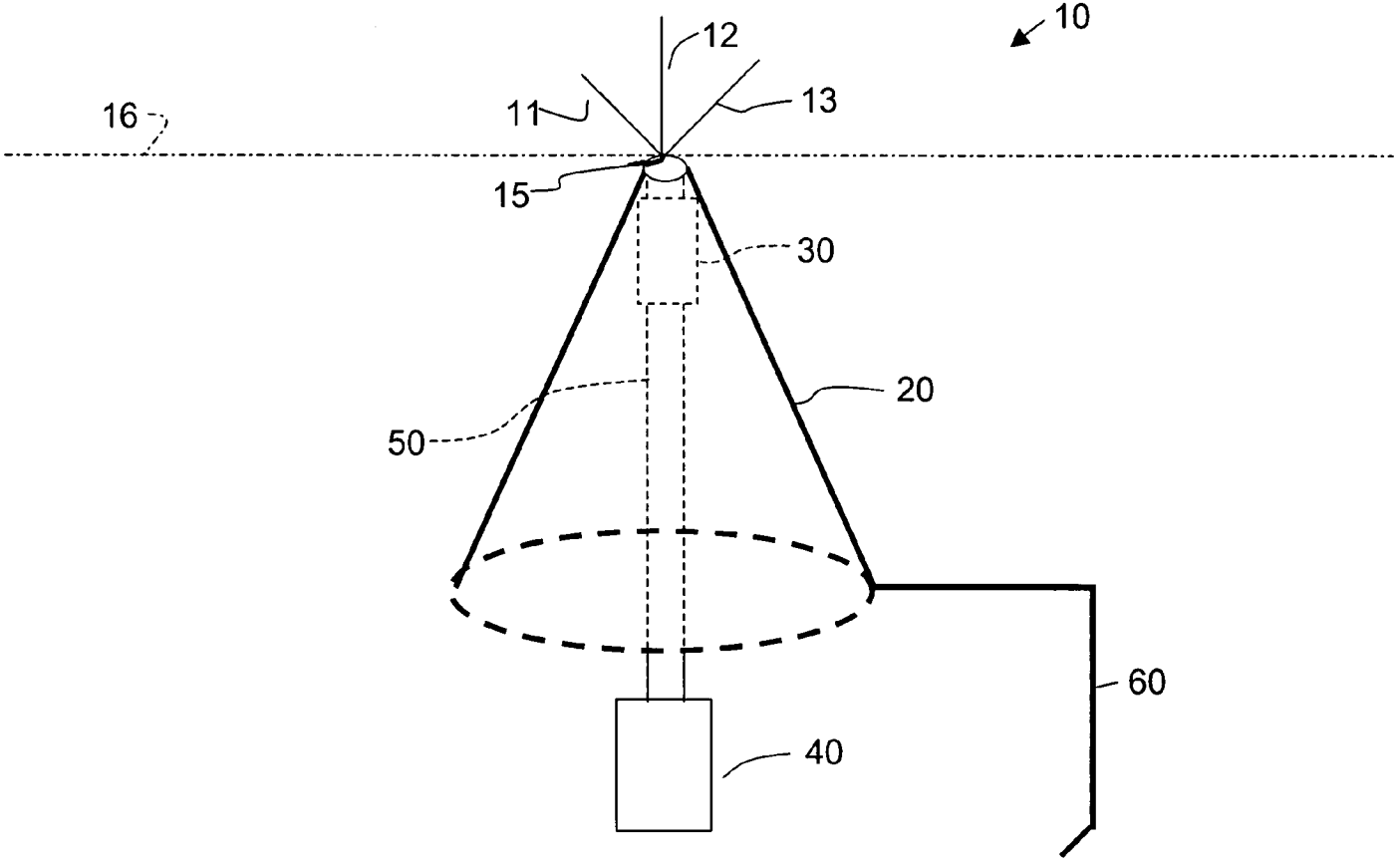
FIG. 1 illustrates a first embodiment of a multi-polarized antenna, in accordance with various aspects of the present invention.
Figure 2:
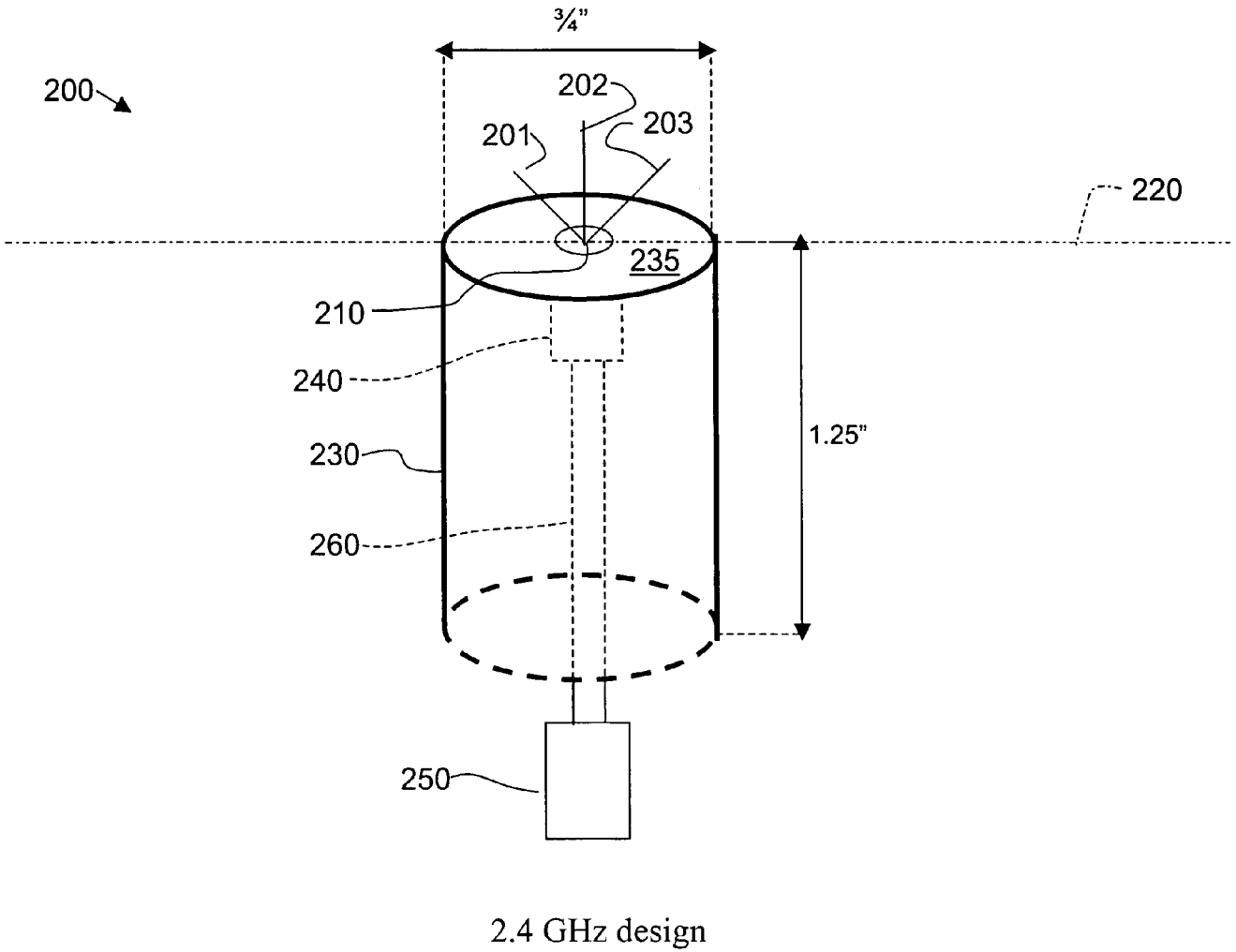
FIG. 2 illustrates a second embodiment of a multi-polarized antenna, in accordance with various aspects of the present invention.
Figure 3:
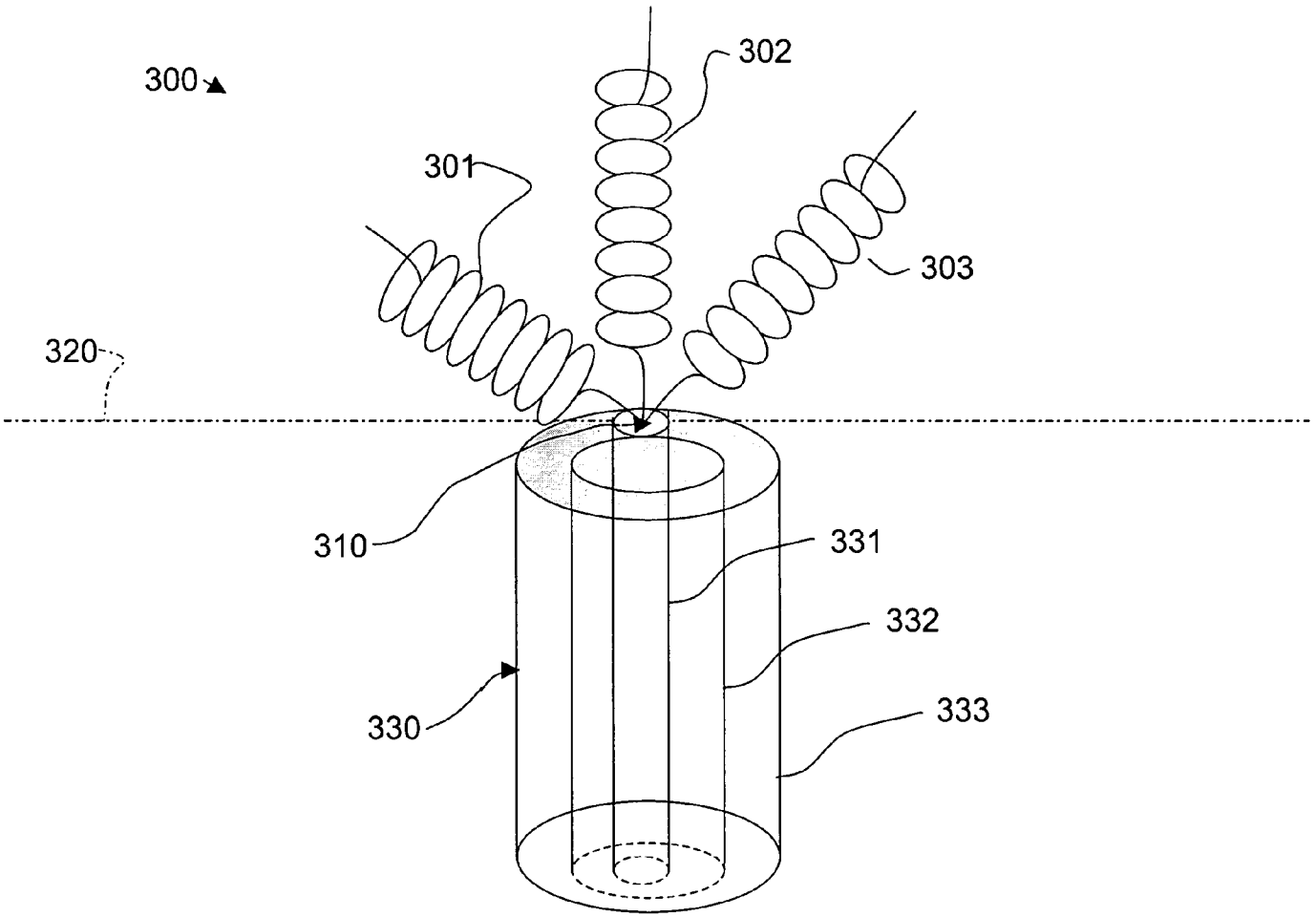
FIG. 3 illustrates a third embodiment of a multi-polarized antenna using coiled antenna elements, in accordance with various aspects of the present invention.

FIGS. 1-3 illustrate several embodiments of the present invention, in accordance with various aspects of the present invention. FIG. 1 illustrates a first embodiment of a multi-polarized antenna 10, in accordance with various aspects of the present invention. The multi-polarized antenna 10 comprises a first radiative antenna element 11, a second radiative antenna element 12, and a third radiative antenna element 13. The three radiative antenna elements 11-13 are electrically connected together at an apex point 15 such that the three radiative antenna elements 11-13 are disposed outwardly away from the apex point 15 at an acute angle of between 1 degree and 89 degrees relative to an imaginary plane 16 intersecting the apex point 15. The radiative antenna elements 11-13 are all located at and/or to a first side of the imaginary plane 16.

In accordance with an embodiment of the present invention, each radiative antenna element 11-13 is substantially linear, coiled or not, and having two ends. Each radiative antenna element 11-13 may be at a unique acute angle or at the same acute angle relative to the imaginary plane 16. In accordance with an embodiment of the present invention, the three radiative elements 11-13 are spaced circumferentially at 120 degrees from each other. Other spacings are possible as well. In a further embodiment of this invention, the radiative antenna elements 11-13 may comprise wound conductive coils. The use of wound conductive coils allows an antenna of substantially smaller size to be manufactured.

The multi-polarized antenna 10 further includes an electrically conductive ground reference 20 that is located at and/or to a second side of the imaginary plane 16 opposite that of the radiating antenna elements 11-13. Unlike previous embodiments, the surface of the ground reference 20 is also disposed outwardly away from the apex point 15 at an acute angle of between 1 and 90 degrees relative to the imaginary plane 16, forming a conical shape. The ground reference 20 may be comprised of any good electrically conductive material such as, for example, copper or stainless steel. The surface of the conically shaped ground reference may be continuous or may be a crosshatched wired mesh, in accordance with various embodiments of the present invention.

Also, a plurality of more than three linear elements disposed in a substantially conical shape may form the ground reference, in accordance with an embodiment of the present invention. However, the less contiguous the ground reference surface, the less bandwidth the antenna will have. In general, the overall physical dimensions of a ground reference may be reduced by providing coiled ground elements as the ground reference. The side length (along the slanted side of the cone) of the conically-shaped ground reference 20 is about ¼ of a wavelength of a tuned radio frequency of operation, in accordance with an embodiment of the present invention, although longer side lengths are possible as well.

In accordance with an embodiment of the present invention, the ground reference 20 may comprise other angled shapes as well such as, for example, a pyramidal shape providing an antenna with certain directional properties. The non-planar ground reference increases the omni-directional coverage (total pattern approaching spherical) of the antenna over that of a planar ground reference (i.e., a ground plane) and allows a "bullet" antenna of substantially smaller size to be manufactured.

The antenna 10 of FIG. 1 also includes an SMA (or otherwise similar) coaxial connector 30 and a transmitting and/or receiving circuit board 40. The connector 30 and circuit 40 are connected together by a length of coaxial cable 50. The connector 30 allows a center conductor of the coaxial cable 50 to electrically connect to the radiative elements 11-13 through a hole in the top of the ground reference 20, and allows a ground braid of the coaxial cable 50 to electrically connect to the ground reference 20. A dielectric material electrically insulates the center conductor (and radiative elements 11-13) from the ground reference 20.

In accordance with an embodiment of the present invention, the center conductor of the coaxial cable 50 may be electrically connected to a "hot" lead of the circuit board 40 and the ground braid of the coaxial cable 50 may be electrically connected to a ground component of the circuit board 40. In accordance with an alternative embodiment of the present invention, the ground component of the circuit board may serve as an adequate ground reference by itself with the radiative elements 11-13 just above and electrically connected to a "hot" lead of the board. The antenna 10 also includes a mounting mechanism 60 to mount the antenna 10 to a structure (e.g., a car, a tower, a building) or another device (e.g., a personal computer, a cell phone). In accordance with an embodiment of the present invention, the mounting mechanism 60 may be mechanically connected to the ground reference 20, for example.

FIG. 2 illustrates a second embodiment of a multi-polarized antenna 200, in accordance with various aspects of the present invention. The multi-polarized antenna 200 comprises a first radiative antenna element 201, a second radiative antenna element 202, and a third radiative antenna element 203. The three radiative antenna elements 201-203 are electrically connected together at an apex point 210 such that the three radiative antenna elements 201-203 are disposed outwardly away from the apex point 210 at an acute angle of between 1 degree and 89 degrees relative to an imaginary plane 220 intersecting the apex point 210. The radiative antenna elements 201-203 are all located at and/or to a first side of the imaginary plane 220.

In accordance with an embodiment of the present invention, each radiative antenna element 201-203 is substantially linear having two ends. Each radiative antenna element 201-203 may be at a unique acute angle or at the same acute angle relative to the imaginary plane 220. In accordance with an embodiment of the present invention, the three radiative elements 201-203 are spaced circumferentially at 120 degrees from each other. In a further embodiment of this invention, the radiative antenna elements 201-203 may comprise wound conductive coils. The use of wound conductive coils allows an antenna of substantially smaller size to be manufactured.

The multi-polarized antenna 200 further includes an electrically conductive ground reference 230 that is located at and/or to a second side of the imaginary plane 220 opposite that of the radiating antenna elements 201-203. Unlike previous embodiments, the ground reference 230 comprises a cylindrical sleeve having a closed upper base side 235. The ground reference 230 may be comprised of any good electrically conductive material such as, for example, copper or stainless steel.

The surface of the cylindrically shaped ground reference may be continuous or may be a crosshatched wired mesh, in accordance with various embodiments of the present invention. Also, a plurality of more than three linear elements disposed in a substantially cylindrical shape may form the ground reference, in accordance with an embodiment of the present invention. The length of the cylindrically shaped ground reference 230 is about ¼ of a wavelength of a tuned radio frequency of operation, in accordance with an embodiment of the present invention, however, the length may be longer. Alternatively, the shield of the coax alone may serve as a ground reference (various styles of stubs, sleeves, matching systems, baluns, transformers, etc. may also be used).

In accordance with an embodiment of the present invention, the antenna 200 is designed to operate at a radio frequency of approximately 2.4 GHz and approximately 5.6 GHz (i.e., dual band operation). The lengths of the radiative elements are approximately ¼ $\lambda$ (where $\lambda$ corresponds to 2.4 GHz). The length of the cylindrical sleeve 230 is 1.25 inches and the diameter of the closed base side 235 is ¾ inches.

In accordance with an embodiment of the present invention, the ground reference 230 may comprise other non-angled sleeve-type shapes such as, for example, a rectangular box shape providing an antenna with certain directional characteristics.

The antenna 200 of FIG. 2 also includes an SMA (or similar) coaxial connector 240 and a transmitter/receiver circuit board 250. The SMA connector 240 and board 250 are electrically connected together by a length of coaxial cable 260. The SMA connector 240 allows a center conductor of the coaxial cable 260 to electrically connect to the radiative elements 201-203 through a hole in the closed base side 235, and allows a ground braid of the coaxial cable 260 to electrically connect to the ground reference 230. A dielectric material electrically insulates the center conductor (and radiative elements 201-203) from the ground reference 230.

FIG. 3 illustrates a third embodiment of a multi-polarized antenna 300 using partially/completely coiled antenna elements, in accordance with various aspects of the present invention. The multi-polarized antenna 300 comprises a first coiled radiative antenna element 301, a second coiled radiative antenna element 302, and a third coiled radiative antenna element 303. The three radiative antenna elements 301-303 are electrically connected together at an apex point 310 such that the three radiative antenna elements 301-303 are disposed outwardly away from the apex point 310 at an acute angle of between 1 degree and 89 degrees relative to an imaginary plane 320 intersecting the apex point 310. The radiative antenna elements 301-303 are all located at and/or to a first side of the imaginary plane 320.

In accordance with an embodiment of the present invention, each radiative antenna element 301-303 comprises a substantially linear wound coil having two ends. Each radiative antenna element 301-303 may be at a unique acute angle or at the same acute angle relative to the imaginary plane 320. In accordance with an embodiment of the present invention, the three radiative elements 301-303 are spaced circumferentially at 120 degrees from each other. In a further embodiment of this invention, the radiative antenna elements 301-303 may comprise uncoiled linear conductive elements. The use of wound conductive coils, however, allows an antenna of substantially smaller size to be manufactured. The conductive wound coils allow the small antenna to perform similarly to a larger antenna that uses linear elements instead of wound coils at the same operating frequency.

The multi-polarized antenna 300 further includes an electrically conductive ground reference 333 that is located at and/or to a second side of the imaginary plane 320 opposite that of the radiating antenna elements 301-303. Unlike previous embodiments, the ground reference 333 comprises the outer conductor of a coaxial connector 330 which comprises a center conductor 331, an insulating dielectric region 332, and the outer conductor 333. However, a ground sleeve as in FIG. 2 may be used, in accordance with an embodiment of the present invention. Also, various styles of stubs, sleeves, matching systems, baluns, transformers, etc. may be used, in accordance with various embodiments of the present invention.

The electrical connector 330 serves to mechanically connect the three radiative antenna elements 301-303 to the ground reference 333 and to allow electrical connection of the radiative antenna elements 301-303 and the ground reference 333 to a transmission line for interfacing to a radio frequency (RF) transmitter and/or receiver. For example, the center conductor 331 electrically connects to the apex 310 of the radiative antenna elements 301-303 and the outer conductor 333 provides a ground reference. The insulating dielectric region 332 electrically isolates the center conductor 331 (and therefore the radiative antenna elements 301-303) from the outer conductor 333 (i.e., the ground reference).

In accordance with other embodiments of the present invention, the number of radiative antenna elements may be only two or may be greater than three. For example, four radiative antenna elements circumferentially spaced at 90 degrees, or otherwise, may be used. In fact, a large number of radiative antenna elements may be effectively replaced with a substantially continuous surface of a cone, a pyramid, or some other substantially continuous shape that is spatially diverse on one side (i.e., has significant spatial extent) and comes substantially to a point (e.g., an apex) on the other side. For example, in accordance with an embodiment of the present invention, a linear radiative antenna element connected at one end to a radiative loop having a significant spatial extent (i.e., radius) may be used.

In accordance with an embodiment of the present invention, the apex point 15 of the radiative antenna elements 11-13 may be electrically connected (e.g., soldered) to a conductive plate. The conductive plate along with the connected radiative antenna elements may be positioned in close proximity to the antenna of a PCMCIA card in, for example, a laptop computer. As a result, the conductive plate may resonantly couple to the "hot" lead of the PCMCIA card antenna, providing multi-polarization capability. The ground component of the PCMCIA card may serve as an adequate ground reference by itself with the radiative elements 11-13 just above and resonantly coupled to a "hot" lead of the antenna of the PCMCIA card. In accordance with various embodiment of the present invention, the conductive plate may comprise various sizes and shapes.

In accordance with an embodiment of the present invention, the radiative elements may comprise a combination of linear, uncoiled members and coiled members. The coiled members may be at an end of each linear, uncoiled member or in the middle of each linear, uncoiled member, for example. Such configurations provide for more broad banded operation. For example, an embodiment where the radiative elements are approximately three inches in length, having both linear members and coiled members, can provide performance from 750 MHz to 950 MHz (cell, government, commercial operation), 1.2 GHz (GPS operation), 1.8 GHz and 1.9 GHz (Europe's GSM and PCS operation), 2.4 GHz operation, and 5.x GHz operation (approximately 5.15 GHz to 5.85 GHz).

Figure 4:
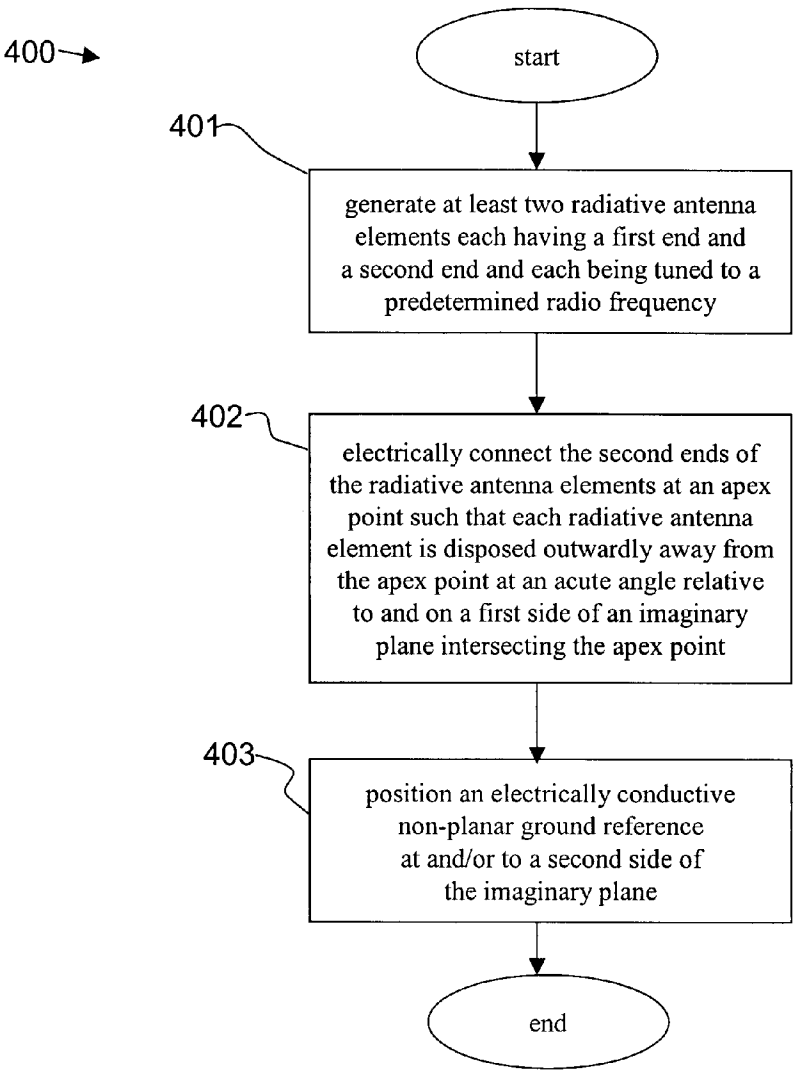
FIG. 4 is a flowchart of an embodiment of a method to construct any of the antennas of FIG. 1-3, in accordance with various aspects of the present invention.

FIG. 4 is a flowchart of an embodiment of a method 400 to construct any of the antennas of FIG. 1-3, in accordance with various aspects of the present invention. In step 401, at least two radiative antenna elements are generated, each having a first end and a second end and each being tuned to a predetermined radio frequency. In step 302, the second ends of the radiative antenna elements are electrically connected together at an apex point such that each radiative antenna element is disposed outwardly away from the apex point at an acute angle relative to and on a first side of an imaginary plane intersecting the apex point. In step 303, an electrically conductive, non-planar ground reference is positioned at or to a second side of the imaginary plane.

In accordance with various embodiments of the present invention, each radiative antenna element may be tuned to a different radio frequency, to the same radio frequency, or to some combination thereof. For example, in accordance with an embodiment of the present invention, each radiative antenna element 11-13 is cut to a physical length that is tuned to approximately one-quarter wavelength of a desired radio frequency of transmission.

With all properties including inductive reactance, capacitive reactance and resistive impedance components of the antenna elements and elemental interactions considered, there is a resultant tri-band impedance matched broadband performance at about ¼ λ, ⅜ λ, and 0.7 λ related frequency (cut) areas. The antenna becomes even more broad banded by using unequal length radiative antenna elements such as, for example, 1.0x, 1.1x, and 0.9x lengths, where x is some initial length of one of the antenna elements. With these issues and adaptations of the well-known k-factor, final lengths are cut per analysis.

Generally, the near spherical patterning of the antenna is enhanced the larger the angle is between the ground reference and the imaginary plane at the radiative element apex, and the smaller the angle is between the radiative elements and the imaginary ground plane.

In accordance with an embodiment of the present invention, the antennas of FIGS. 1-3 may be enclosed in a protective housing that is transparent to electromagnetic waves. This helps to protect the antennas from various detrimental environmental effects due to, for example, wind and rain. The protective housing may include the housing for a cell phone, a PC, or some other electronic device, for example. The resultant compact size of the antennas at certain operating radio frequencies make them ideal for integration into small portable devices such as cell phones and portable PC's, for example.

Figure 5:
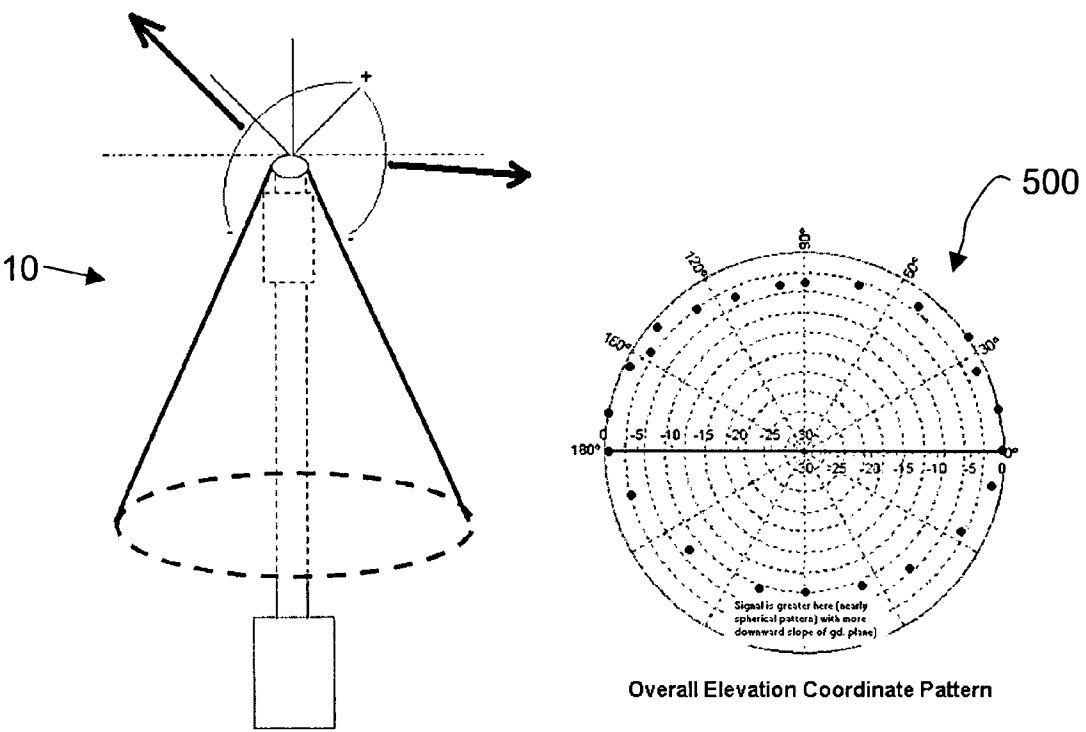
FIG. 5 illustrates the elevation antenna pattern of the multi-polarized antenna of FIG. 1, in accordance with an embodiment of the present invention.

FIG. 5 illustrates the elevation antenna pattern 500 of the multi-polarized antenna 10 of FIG. 1, in accordance with an embodiment of the present invention. The antenna 10 of FIG. 1 is highly omni-directional, both above and below the horizon. With the antenna 10 positioned with the radiative antenna elements pointing generally upward and the ground reference being conical, the elevation antenna pattern 500 is highly omni-directional. As a result, the multi-polarized antenna 10 has excellent performance not only at or near the horizon, but also from above and below at multiple polarizations.

For example, if antenna 10 is sitting in a valley and is connected to a personal digital assistant (PDA) for wireless connection to the Internet, the antenna 10 may still be able to reliably connect to the Internet by taking advantage of a preferred polarized path signal upward and out of the valley. A PDA using a simple vertically polarized antenna may not be able to transmit and receive reliably out of the valley to establish a connection to the Internet. Furthermore, multi-polarization and near spherical patterning features of the antenna will allow the Internet connection to be maintained as the user holds the PDA in multiple positions. The spatial diversity of the ends of the radiative antenna elements 11-13 allows the PDA to connect to the strongest signal.

Figure 6:
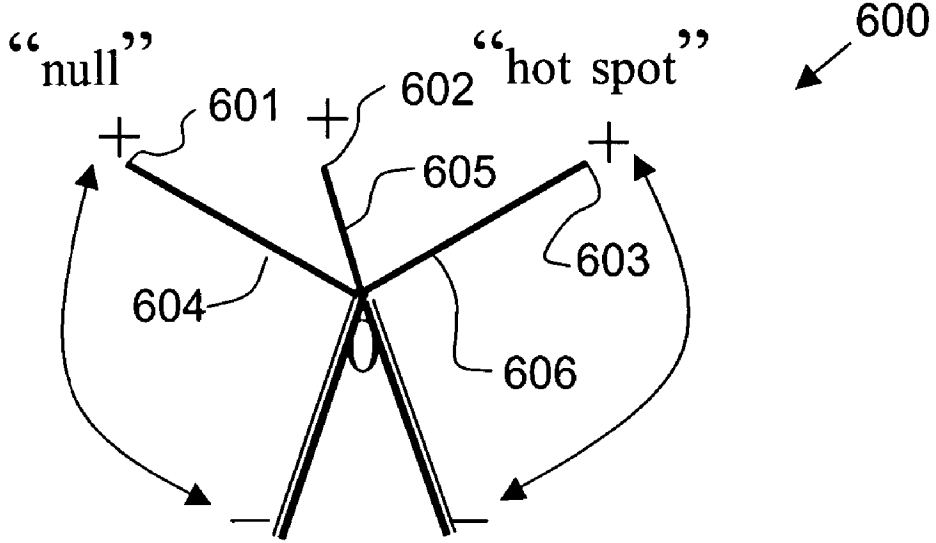
FIG. 6 illustrates the concept of geometric spatial capture of signal provided by the antennas of FIGS. 1-3, in accordance with various aspects of the present invention.

FIG. 6 illustrates the concept of geometric spatial capture of signal provided by the antenna 600 (i.e., any of the antennas of FIGS. 1-3), in accordance with various aspects of the present invention. The first ends 601, 602, and 603 of the three radiative antenna elements 604, 605, and 606 are spatially separated from each other over the ground reference 610. Radio frequency multi-path signals originating at some other source and intersecting the antenna 600 may produce a "null" or cancellation (dead or very low signal) at radiative antenna element 601 but produce a "hot spot" or strong signal at radiative antenna element 603. As a result, the signal may still be received by the antenna 600 because of the spatial diversity of the radiative antenna elements 604-606. If the antenna 600 is connected to a mobile device such as a cell phone, the unwanted effect of signal fluttering (alternating weak and strong signal reception normally experienced with a single element antenna while in motion) is greatly reduced if not totally eliminated due to the spatial diversity (i.e., spatial separation) of the ends 601-603 of the radiative antenna elements 604-606. This capability is known as "geometric spatial capture of signal".

Figure 7:
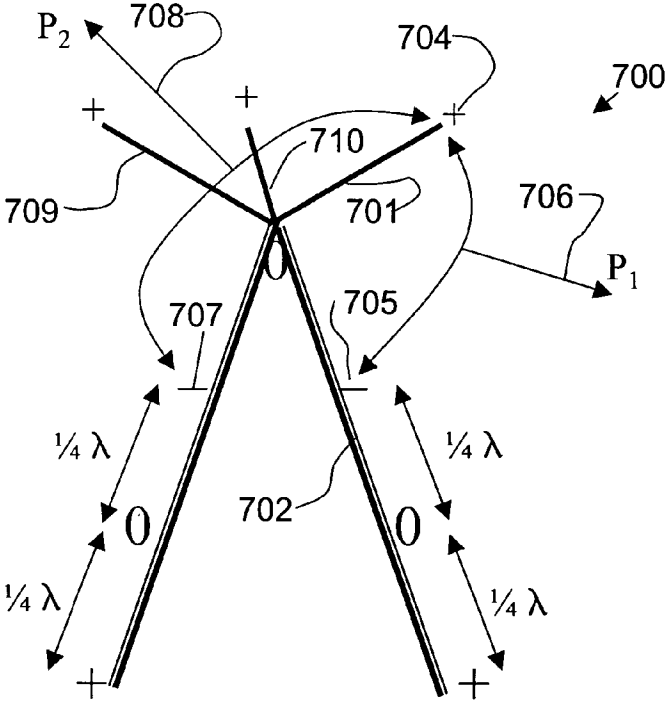
FIG. 7 illustrates the concept of multi-polarization provided by the antennas of FIGS. 1-3, in accordance with various aspects of the present invention.

FIG. 7 illustrates the concept of multi-polarization provided by the antenna 700 (i.e., any of the antennas of FIGS. 1-3), in accordance with various aspects of the present invention. Polarization (i.e., the direction of the electric field vector E in the far field) is determined largely by the orientation of the radiative antenna element with respect to the ground reference. The direction of propagation of the resultant electromagnetic wave is perpendicular to the electric field vector. In FIG. 7, a radiative antenna element 701 is shown over a ground reference 702 to form the antenna 700. When a sinusoidal voltage signal is fed into the antenna 700 (e.g., via a transmission line), alternating electric charge is formed on the radiative antenna element 701 and the ground reference 702. The "+" symbols represent positive charge corresponding to the positive peaks of the sinusoidal signal, the "−" symbols represent negative charge corresponding to the negative peaks of the sinusoidal signal, and the "0" symbols represent the zero crossing points of the sinusoidal signal feeding the antenna 700. The "+", "−", and "0" charges are separated across the ground reference by one-quarter wavelength (¼ λ) as would be expected based on a sinusoidal waveform.

The illustration in FIG. 7 is a snapshot in time of the charges on the radiative antenna element 701 and the ground reference 702. As can be seen in FIG. 7, different polarizations or radiated electric (E) fields will be generated between the "+" on the end of the radiative antenna element 701 and the "−"'s on the ground reference 702. For example, an E-field is generated between the "+" 704 and the "−" 705 and propagates outward from the antenna 700 in the direction $P_1$ 706 which is perpendicular to the generated electric field. There is also a corresponding magnetic field associated with the electric field to form a complete, radiating electromagnetic wave. The propagating field in the direction of $P_1$ 706 provides a polarized signal substantially below the horizon in the far field.

Another E-field is generated between the "+" 704 and the "−" 707 and propagates outward from the antenna 700 in the direction $P_2$ 708 which is perpendicular to the generated E-field. There is also a corresponding magnetic field associated with the E-field to form a complete, radiating electromagnetic wave. The propagating field in the direction $P_2$ 708 is substantially slanted upward and, therefore, tends to generate an upward-directed slant polarized signal in the far field.

FIG. 7 shows polarizations in only two directions. Other polarizations are formed in other directions as well when going 360 degrees around the radiative antenna element 701. Also, the other antenna elements 709 and 710 generate a plurality of polarized signals in substantially all directions as well.

When multiple radiative antenna elements (e.g., three) are positioned over a ground reference and properly spaced, many more polarizations may be generated and/or received in many more different directions. Therefore, such an antenna is said to be "'multi-polarized" as well as providing "geometric spatial capture of signal". If a transmitting antenna produced all polarizations in all planes (i.e., all planes in an x, y, z coordinate system) and the receiving antenna is capable of capturing all polarizations in all planes, then the significantly greatest preferred polarization path (maximum amplitude signal path) may be availably utilized.

Electromagnetic waves are often reflected, diffracted, refracted, and scattered by surrounding objects, both natural and man-made. As a result, electromagnetic waves that are approaching a receiving antenna can be arriving from multiple angles and have multiple polarizations and signal levels. The antennas of FIGS. 1-3 are able to capture or utilize the preferred approaching signal whether the preferred signal is a line-of-site signal or a reflected signal, and no matter how the signal is polarized.

Figure 8:
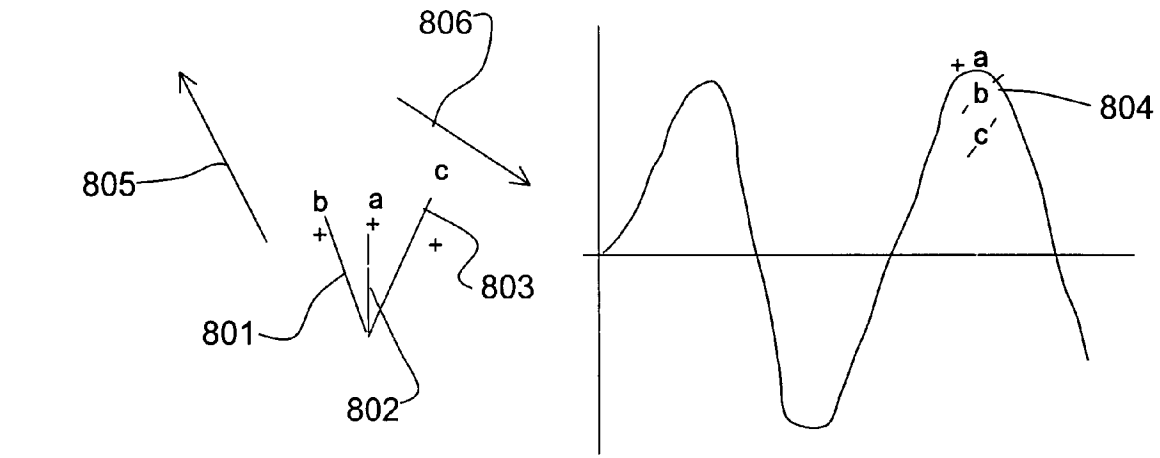
FIG. 8 illustrates the concept of Phase Delay Directives . . . Doppler Frequency Division Multiplexing provided by the antennas of FIGS. 1-3, in accordance with various aspects of the present invention.

FIG. 8 illustrates the concept of Doppler Frequency Division Multiplexing (DFDM) provided by the antennas of FIGS. 1-3, in accordance with various aspects of the present invention. When two active (radiative) vertical ¼ wavelength elements are separated from each other by ¼ wavelength and are both fed a radio frequency signal in phase, a prominence of azimuth signal pattern occurs about a line midway and perpendicular to the line that joins the two active elements. Also, if the two vertical ¼ wavelength elements are fed out of phase by ¼ wavelength, a clear prominence occurs in the direction of the delay-fed element. This is known as a phase-shift directive.

Phase shift directives may also occur with pairs of the slanted radiative antenna elements 801-803 of the antenna 800 shown in FIG. 8. In the antenna 800 of FIG. 8, each radiative antenna element 801-803 transmits signals (a, b, c) of the same frequency but at a slightly different time (or phase) with respect to each other because of the slightly different lengths of the radiative antenna elements 801-803. As a result, based on vector analysis (vector summation 804 of the a b c signals) of such scenarios, phase-shift directives (e.g., 805 and 806) can occur.

Particularly in a multi-antenna array, these phase-shift directives may be beneficial in and of themselves individually per antenna in non-line-of-sight (NLOS) scenarios and in a statistically advantageous manner with multiple antennas for maintenance of some usable signal.

Furthermore, when a driven antenna 800 is mechanically rotated on axis (i.e., spun), with the phase-shift directives considered, the benefits of (V)OFDM circuitry are mimicked and called Doppler Frequency Division Multiplexing (DFDM). An optimized rotation rate may be found in a stable NLOS environment and continued variations in the rotation rate may benefit performance in a changing obstructed environment. The rotation rate may be accomplished by connecting a small electric motor, for example, to the antenna 800 or to one of the antennas of FIGS. 1-3, in accordance with various embodiments of the present invention.

Certain circuit technology that, when combined with the antenna technologies herein may produce even further benefits, include (V)OFDM, switching phased arrays, Doppler switching circuitry of the active slant elements, and circular phase delay (circuit board strips, etc.) feed of the active slant elements. Although terrestrial and satellite signals are benefited by the basic technology described herein, the combination with the circular phase delay feed technology has been shown to clearly improve mobile (data) satellite radio performance (e.g., XM, Sirius).

Indoor and outdoor obstructions can produce reflections, diffractions, refractions, and scattering of radio waves. The multi-polarized antennas of FIGS. 1-3 are able to receive all polarizations and capture the changing, highly preferred (i.e., best polarization) pathway, holding the communication where standard antennas fall short.

With each side of a communication link using one of the antennas of FIGS. 1-3, signals of all polarizations are produced upon transmission. These multiple signals may all be received and, due to the geometric design of the antennas of FIGS. 1-3, a plurality of the multiple signals tend to add together in phase in line-of-sight (LOS) and non-line-of-sight (NLOS) (where maximum signal is still of a direct point-to-point pathway and there is a most preferred maximum penetration polarization) scenarios upon reception. Any singularly polarized noise from out-of-phase multi-path or signals from other sources account for just a small part of the total.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A compact multi-polarized antenna for transmitting and/or receiving radio frequency (RF) signals, said antenna comprising:

at least two radiative antenna elements each having a first end and a second end, and wherein said second ends of said radiative antenna elements are electrically connected at an apex point and are each disposed outwardly away from said apex point at an acute angle relative to and on a first side of an imaginary plane intersecting said apex point, and wherein said acute angle between each of said radiative antenna elements and said imaginary plane is between 1 degree and 89 degrees; and an electrically conductive, cylindrical shaped ground reference having a closed upper base side, located at and/or to a second side of said imaginary plane.

2. The antenna of claim 1 further comprising a dielectric material serving to mechanically connect, at least in part, said radiative antenna elements to said ground reference while electrically insulating said radiative antenna elements from said ground reference.

3. The antenna of claim 2 further comprising an electrical conductor electrically connected to said radiative antenna elements at said apex point and extending away from said apex point toward a ground reference side of said antenna through said dielectric material to allow connection to a transmission line for interfacing said radiative antenna elements to a radio frequency transmitter and/or receiver.

4. The antenna of claim 1 further comprising an electrical connector to allow connection of said radiative antenna elements and said ground reference to a transmission line.

5. The antenna of claim 1 wherein said at least two radiative antenna elements comprise conductive wound coils each tuned to a predefined radio frequency.

6. The antenna of claim 1 wherein each of said radiative antenna elements are substantially linear and have a physical length determined by a pre-defined radio frequency.

7. The antenna of claim 1 wherein said ground reference has a length of about ¼ wavelength of a tuned radio frequency.

8. The antenna of claim 1 wherein said ground reference comprises an outer conductor of a coaxial connector.

9. The antenna of claim 1 further comprising a mounting mechanism to allow mounting of said antenna to another device or structure.

10. The antenna of claim 1 wherein said radiative antenna elements are equally spaced in angle circumferentially around 360 degrees.

11. A method to construct a compact multi-polarized antenna for transmitting and/or receiving radio frequency (RF) signals, said method comprising:

generating at least two radiative antenna elements each having a first end and a second end and each being tuned to a predetermined radio frequency;

electrically connecting said second ends of said radiative antenna elements at an apex point such that each radiative antenna element is disposed outwardly away from said apex point at an acute angle relative to and on a first side of an imaginary plane intersecting said apex point, and wherein said acute angle between each of said radiative antenna elements and said imaginary plane is between 1 degree and 89 degrees; and positioning an electrically conductive, cylindrical shaped ground reference having a closed upper base side, at and/or to a second side of said imaginary plane.

12. The method of claim 11 further comprising mechanically connecting said radiative antenna elements to said ground reference using at least a dielectric material to electrically insulate said radiative antenna elements from said ground reference.

13. The method of claim 12 further comprising connecting an electrical conductor to said radiative antenna elements at said apex point such that said electrical conductor extends away from said apex point toward a ground reference side of said antenna and through said dielectric material to allow connection to a transmission line for interfacing said radiative antenna elements to a radio frequency transmitter and/or receiver.

14. The method of claim 11 further comprising connecting an electrical connector to said radiative antenna elements and said ground reference to allow connection of said antenna to a transmission line.

15. The method of claim 11 wherein said at least two radiative antenna elements comprise conductive wound coils.

16. The method of claim 11 wherein said ground reference has a length of about ¼ wavelength of said tuned radio frequency.

17. The method of claim 11 wherein said ground reference comprises an outer conductor of a coaxial connector.

18. The method of claim 11 wherein generating each of said at least two radiative antenna elements comprises cutting a substantially linear conductive material to a predetermined physical length.

19. The method of claim 11 wherein generating each of said at least two radiative antenna elements comprises winding a coil of conductive material to a predetermined electrical length.

20. The method of claim 11 wherein said predetermined radio frequency for each of said radiative antenna elements is substantially the same for each of said radiative antenna elements.

21. The method of claim 11 wherein said predetermined radio frequency for each of said radiative antenna elements is substantially different for each of said radiative antenna elements.

22. The method of claim 11 further comprising connecting a mounting mechanism to said antenna to allow mounting of said antenna to another device or structure.

23. The method of claim 11 wherein said radiative antenna elements are equally spaced in angle circumferentially around 360 degrees.

24. The method of claim 11 further comprising mechanically connecting a motor to said multi-polarized antenna to allow rotation of said multi-polarized antenna about a defined axis of said antenna.

25. A compact multi-polarized antenna for transmitting and/or receiving radio frequency (RF) signals, said antenna comprising:

at least two radiative antenna elements each having a first end and a second end, and wherein said second ends of said radiative antenna elements are electrically connected at an apex point and are each disposed outwardly away from said apex point at an acute angle relative to and on a first side of an imaginary plane intersecting said apex point, and wherein said acute angle between each of said radiative antenna elements and said imaginary plane is between 1 degree and 89 degrees; and an electrically conductive, cylindrically-shaped ground reference located at and/or to a second side of said imaginary plane.

26. A method to construct a compact multi-polarized antenna for transmitting and/or receiving radio frequency (RF) signals, said method comprising:

generating at least two radiative antenna elements each having a first end and a second end and each being tuned to a predetermined radio frequency;

electrically connecting said second ends of said radiative antenna elements at an apex point such that each radiative antenna element is disposed outwardly away from said apex point at an acute angle relative to and on a first side of an imaginary plane intersecting said apex point, and wherein said acute angle between each of said radiative antenna elements and said imaginary plane is between 1 degree and 89 degrees; and positioning an electrically conductive, cylindrically-shaped ground reference at and/or to a second side of said imaginary plane.

* * * * *